US005775609A

United States Patent [19]

Ackers et al.

[11] Patent Number: 5,775,609

[45] Date of Patent: Jul. 7, 1998

[54] HORIZONTAL IMPACT CRUSHER HAVING HYDRAULIC COVER LATCH

[75] Inventors: Stephen B. Ackers, deceased, late of Columbia, S.C.; Jennifer Ackers, legal representative, Clackamas, Oreg.; Donley D. Freshwater, Columbia, S.C.

[73] Assignee: W. S. Tyler, Incorporated, Gastonia, N.C.

[21] Appl. No.: 615,093

[22] Filed: Mar. 13, 1996

(Under 37 CFR 1.47)

[51] Int. Cl.[6] ..... B02C 13/282

[52] U.S. Cl. ..... 241/285.3

[58] Field of Search ..... 241/285.2, 285.3, 241/37.5

[56] References Cited

U.S. PATENT DOCUMENTS

| | | | |
|---|---|---|---|
| 4,198,005 | 4/1980 | Eiff | 241/285.3 X |
| 4,313,631 | 2/1982 | Johnson . | |
| 4,661,036 | 4/1987 | Horsch . | |
| 5,435,050 | 7/1995 | Alt | 241/285.3 X |
| 5,513,811 | 5/1996 | Phan Hung | 241/285.3 |

*Primary Examiner*—Mark Rosenbaum
*Attorney, Agent, or Firm*—Donald L. Beeson

[57] ABSTRACT

A horizontal impact crusher having a frame cover for accessing the machine's crushing chamber is provided with hydraulic cover latches for opening and closing the frame cover.

11 Claims, 4 Drawing Sheets

HORIZONTAL IMPACT CRUSHER HAVING HYDRAULIC COVER LATCH

BACKGROUND OF THE INVENTION

The present invention generally relates to crushing machines for materials benefication, and more particularly to horizontal impact crushing machines and the need to periodically access the crushing chamber for such machines.

Horizontal impact crushing machines are well-known in the art and have been in use for many years. Such machines utilize "blow bars" (sometimes called "breaker" or "impact" bars) on the perimeter of a rotor assembly rotating at high speeds to propel crushable material against work-hardened wall structures, called "curtains." The resulting impact forces act to pulverize the material fed into the crusher.

From time to time it is necessary to access the interior of a horizontal impact crushing machine for maintenance purposes or to dislodge uncrushable materials. Conventionally, such access is provided by means of a frame cover that is rotated on the base of the machine to an open position by means of a hydraulic cylinder. In a closed position, such a frame cover is held to the stationary portion of the frame by means of mechanical latches which are difficult to access and operate, since they require an operator to climb up onto the machine and physically undo the latches, which typically requires a tool to break the latches free. The difficulty of gaining access to the crusher having conventional cover latches leads to costly down time, and creates conditions that can lead to injuries where proper safety procedures are not followed. For example, if the machine is accidentally turned on when a maintenance person is on the machine, severe injury could result.

The present invention provides a means for latching and unlatching the access cover of a horizontal impact crusher without the need for a maintenance person to climb onto the machine for the purpose of mechanically operating the latches. The invention permits the access cover to be latched and unlatched quickly and efficiently, thereby minimizing down time, and also reduces the risk of injury to the maintenance person.

SUMMARY OF THE INVENTION

The present invention involves a horizontal impact crusher having a base, an upright crusher frame supported on the base, and an interior crushing chamber. The crusher frame is divided into a stationary portion and a movable cover portion that is pivotally attached to the base to permit the cover to pivot to an open position. Both the stationary portion and movable covered portion of the frame have interior edge structures which meet and are latched together when the covered portion is in a closed position. In accordance with the invention, latch means for the covered portion are provided in the form of hydraulically actuated latch means which can be remotely actuated without the need for a maintenance person to climb onto the machine. The hydraulic latch means is preferably normally closed, such that, the latches can only be unlatched with the application of hydraulic pressure. Such a safety feature will prevent the accidental unlatching of the frame cover due to loss of hydraulic pressure. It is further contemplated that the crusher's motor can be interlocked with the hydraulic latches, such that, for safety, the crusher cannot be operated when the frame cover is open.

Therefore, it can be seen that a primary object of the invention is to provide an efficient means of unlatching the access cover of a frame of a horizontal impact crusher.

Another object of the invention is to provide a latching mechanism for the frame's cover that will reduce down time and enhance the safety environment of the crusher. Other objects of the invention will become apparent from the following description and claims, as well as the accompanying drawings.

DETAILED DESCRIPTION OF THE ILLUSTRATED EMBODIMENT

Figure 1:
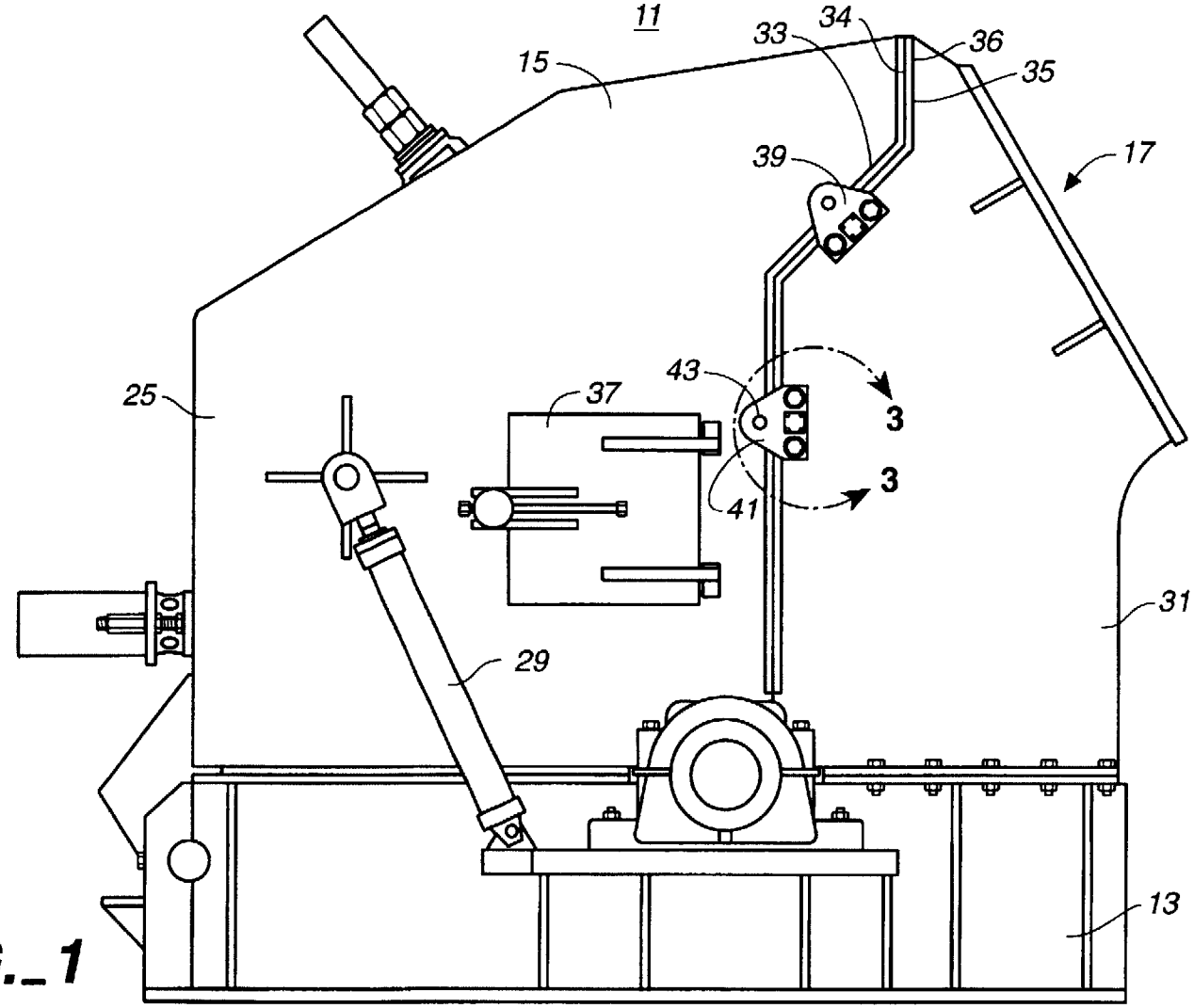
FIG. 1 is a side elevational view of a horizontal impact crusher having hydraulic cover latches in accordance with the invention.
Figure 2:
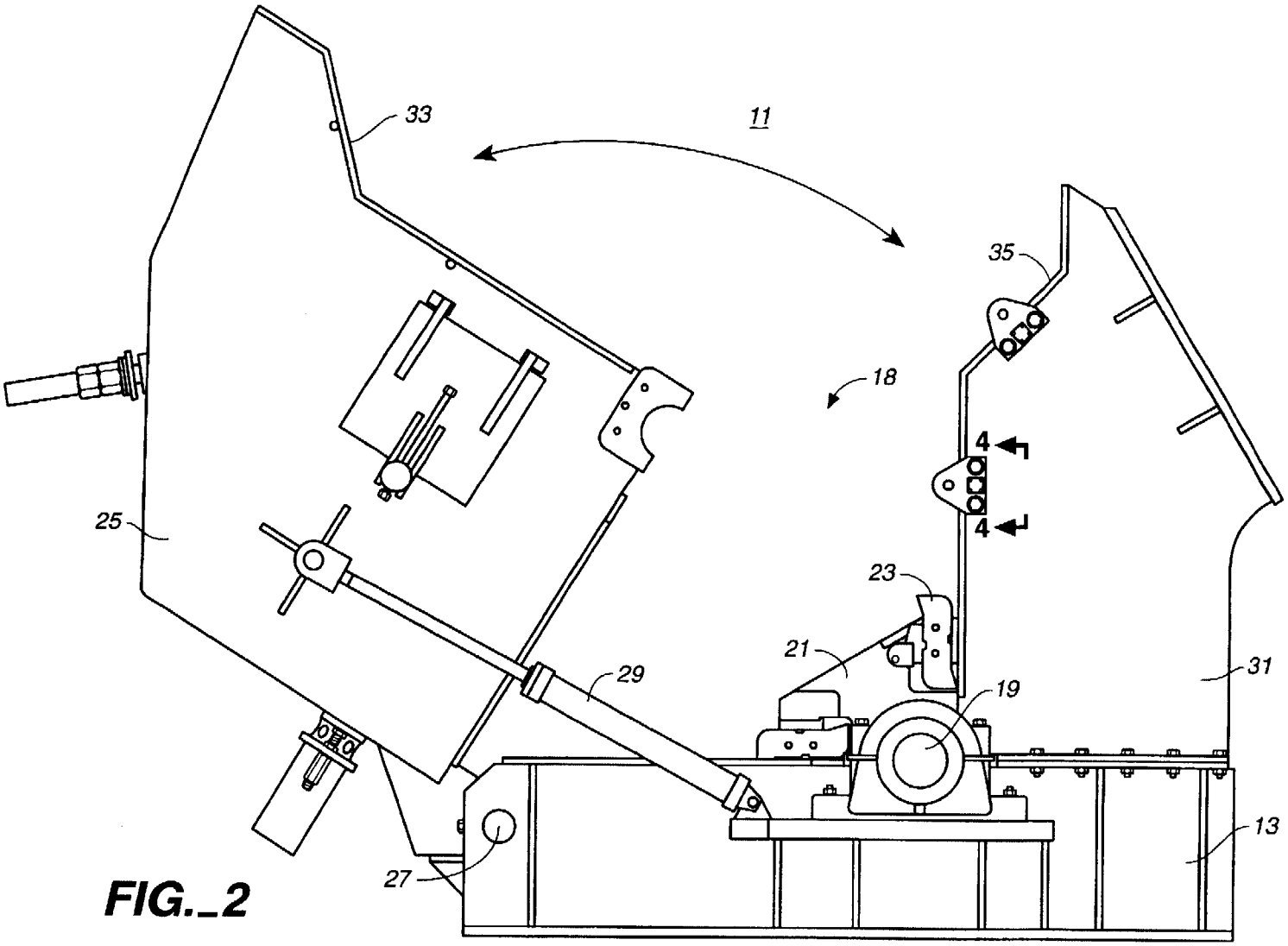
FIG. 2 is a side elevational view of the horizontal impact crusher shown in FIG. 1, with the frame cover opened.

Referring now to the drawings, FIGS. 1 and 2 show the general configuration of a horizontal impact crusher (denoted by the numeral 11) having a base portion 13, an upright crusher frame 15, a top feed opening 17 and an internal crushing chamber 18. During operation, drive motor 19 mounted to the exterior of frame 15 drives internal rotor assembly 21 such that the rotor assembly's blow bars 23 propel crushable material fed through feed opening 17 against the surfaces of a series of internal curtain assemblies (not shown). The blow bars experience considerable wear due to the rugged operating environment of the crusher and because of this, the crushing chamber needs to be periodically accessed to replace the blow bars, and to make other repairs. The interior crushing chamber may also have to be accessed to remove uncrushable material that find its way into the machine.

To permit such access, crusher frame 15 is seen to have a rear cover portion 25 pivotally attached to base 13 at pivot point 27, which is actuated from a closed to an opened position as shown in FIG. 2 by externally mounted hydraulic cylinders 29. It can be seen that the frame's cover portion 25, which accounts for over half of the crusher's total frame structure, breaks away from a front stationary portion 31 of the frame just behind feed opening 17. Both the stationary portion 31 and movable cover portion 25 have mating interior edge structures 33, 35 that extend from the top of the crusher frame to the crusher's base 13. To provide reinforced edges, each edge structure is lined with transversely extending rim plates 34, 36. It is noted that the crusher frame can also be provided with smaller hatch doors, such as door 37, which can be used for inspection and light maintenance purposes.

Figure 3:
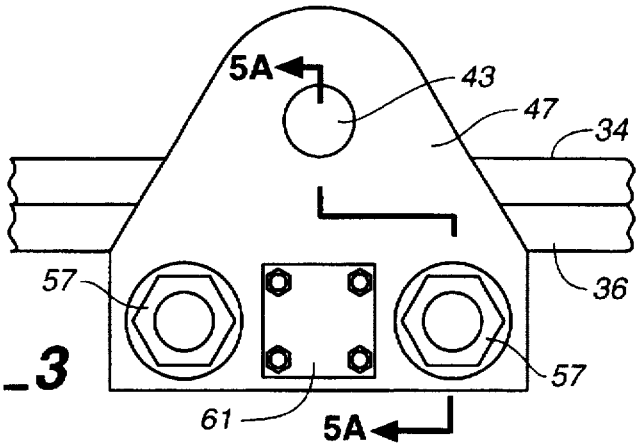
FIG. 3 is a top plan view of the hydraulic latch plate assembly of the invention attached to the interior edge structures of the stationary and movable portions of the crusher frame.

When closed, the movable frame cover 25 is latched to the stationary frame portion 31 along interior edge structures 33, 35 by hydraulically actuated latch means in the form of two identical latch plate assemblies 39, 41 positioned at two different locations along the mating interior edge structures. These latch plate assemblies are now described with reference to FIGS. 3–5, which illustrate the construction and operation of latch plate assembly 41.

Latch plate assembly 41 is seen to include a latch post 43 secured to side wall 45 of frame cover 25 just to the inside of rim plate 34. The rest of latch plate assembly 41 is mounted to the frame's front stationary portion 31 opposite latch post 43. More specifically, a latch mechanism in the form of latch plate 47 having post hole 49 is mounted to edge structure 35 of the stationary frame portion by means of mounting bolts 51, which are anchored into mounting block 53 welded into the frame corner formed by rim plate 36 and the stationary frame's side wall 46. Locking plate 47, which is slidably carried on mounting parts in the form of bolts 51, is biased to the closed position shown in FIG. 5A by spring means in the form of coil springs 55 which extend between the top of the latch plate and the enlarged head portion provided by bolt heads 57. Washers 59 can suitably be provided between the ends of mounting springs 55 and the bolt heads.

Figure 4:
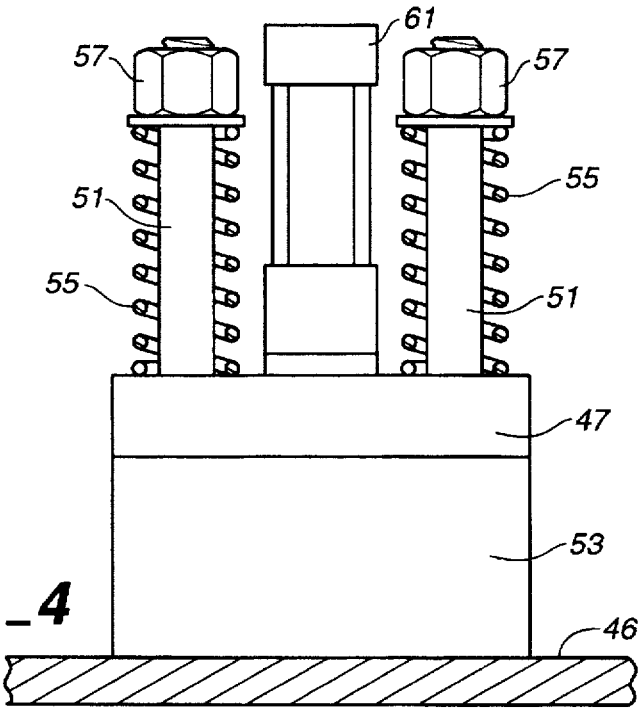
FIG. 4 is a side elevational view of the latch plate assembly shown in FIG. 3.

As best seen in FIG. 4, hydraulic actuation of locking plate assembly 41 is accomplished by hydraulic cylinder 61 which is mounted to latch plate 47 between the two spring loaded mounting bolts 51. Hydraulic cylinder 61 can suitably be a commercially available low pressure hydraulic cylinder having an operating range of 750 psi to 1500 psi. One such commercially available cylinder is the series LH low pressure hydraulic cylinder supplied by the Fluid Power Division of Versa Tek Company.

Figure 5A:
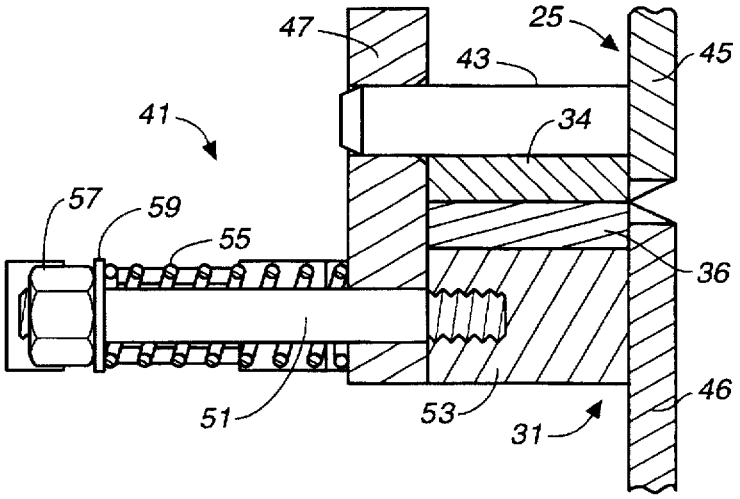
FIGS. 5A–5C are cross-sectional views of the latch plate assembly shown in FIGS. 3 and 4, illustrating the operation of this assembly.
Figure 5B:
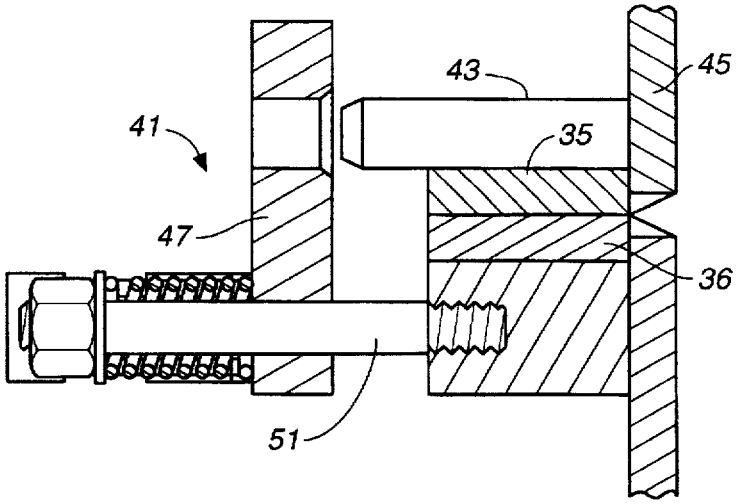
Figure 5C:
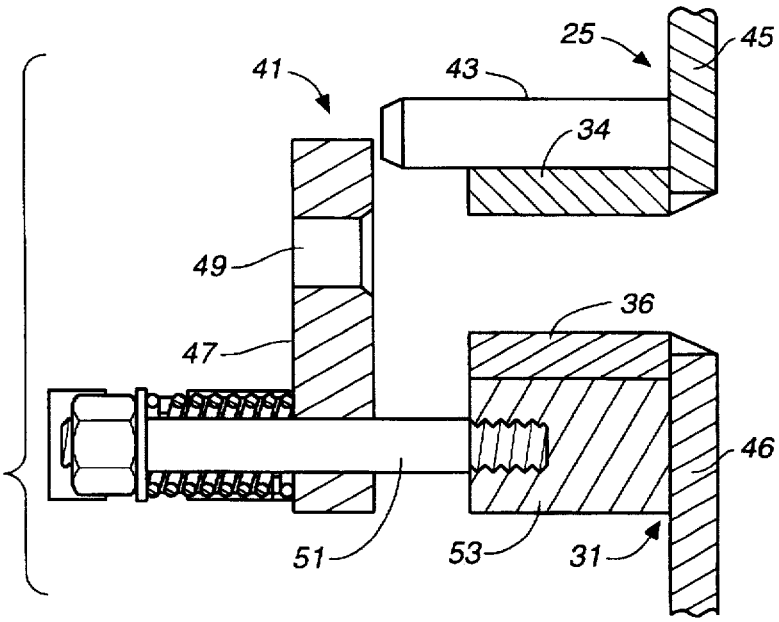

The operation of the latch plate assembly is now described in reference to FIGS. 5A–5C. When frame cover 25 is in its closed position, latch plate 47 extends over and engages latch post 43 in the latch plate's post hole 49. Compression springs 55 of the latch spring assembly bias the latch plate into the normally closed locking position shown in FIG. 5A, thereby locking the frame cover in place. When hydraulic pressure is applied to hydraulic cylinder 61, latch plate 47 is retracted to an unlocked position as shown in FIG. 5B to disengage from post 43. When thusly retracted, the frame cover 25 can be swung away from stationary frame 31 as shown in FIG. 5C. Loss of hydraulic pressure will prevent the latch plate assembly from being opened.

When frame cover 25 is closed, it can be locked in place by latch plate assemblies 39, 41 by simply releasing the hydraulic pressure to permit the locking plates of the assemblies to engage their associated locking posts.

Figure 6:
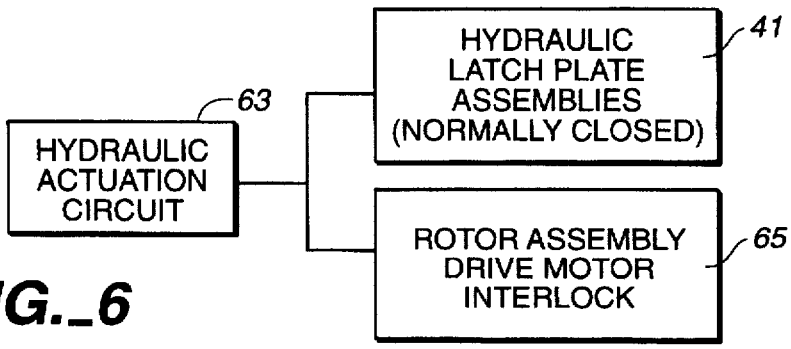
FIG. 6 is a block diagram of the hydraulic actuation circuit and drive motor interlock of the invention.

FIG. 6 generally illustrates in block diagram form the safety features of the invention. A hydraulic circuit represented by block 63 is provided to actuate the machine's latch plate assemblies from a normally closed condition such that the frame cover cannot open in the absence of hydraulic pressure. The hydraulic actuation circuit is additionally employed to actuate an interlock 65 for preventing the rotor assembly drive motor from operating when the hydraulic latch assemblies are in an opened condition. Such a safety feature will prevent any inadvertent operation of the machine when a worker is in the vicinity of an open crusher. It will be appreciated that a hydraulic actuation circuit and drive motor interlock can be provided in accordance with designs well-known to persons of ordinary skill in the art.

Therefore, it can be seen that the present invention provides a means for readily and efficiently latching and unlatching the frame cover of a horizontal impact crusher and at the same time improving the crusher's safety environment. While the invention has been described in considerable detail in the foregoing specification and the accompanying drawings, it is understood that it is not intended that the invention be limited to such detail, except as necessitated by the following claims.

What we claim is:

1. In a horizontal impact crusher having a base, a crusher frame on said base, and an interior crushing chamber within said crusher frame, said crusher frame including a stationary portion having a first interior edge structure, and a cover portion movable between a closed and open position to access said interior crushing chamber, said cover portion having a second interior edge structure that mates with the first interior edge structure of the stationary portion of said frame when said cover portion is closed, a latch assembly comprising a latch mechanism secured to the edge structure of one of the stationary and cover portions of said crusher frame, said latch mechanism being moveable between an unlocked position where the cover portion of said crusher frame can be opened and a locked position where the cover portion of the crusher frame, when closed, is secured to the stationary portion of the crusher frame, hydraulic means for hydraulically moving said latch mechanism to its unlocked position by exerting a sufficient hydraulic actuation force thereon, and spring means for mechanically biasing said latch mechanism to its locked position in the absence of a sufficient hydraulic actuation force from said hydraulic means whereby the latch mechanism remains in a normally locked position.

2. The latch assembly of claim 1 wherein said latch mechanism is in the form of a latch plate disposed to span the edge structures of the stationary and cover portions of said crusher frame and wherein said latch plate is raised to an unlocked position by said hydraulic means and lowered to a locked position by said spring means.

3. The latch assembly of claim 2 further comprising at least one mounting post extending from the edge structure of one of the stationary and cover portions of said crusher frame, and wherein said latch plate is slidably carried on said mounting post and is raised and lowered thereon by said hydraulic means and spring means.

4. The latch assembly of claim 3 wherein said mounting post has a head portion and said spring means includes a compression spring disposed over said mounting post between the head portion thereof and said latch plate so as to lower said latch plate on said mounting post in the absence of a sufficient hydraulic actuation force from said hydraulic means.

5. The latch assembly of claim 4 wherein said latch plate is carried on at least two mounting posts and a compression spring is provided for each mounting post.

6. The latch assembly of claim 4 wherein said hydraulic means includes a hydraulic cylinder mounted directly to said latch plate.

7. The latch assembly of claim 4 wherein a latch post positioned in opposition to said latch plate extends from the edge structure of the other of the stationary and cover portions of said crusher frame, and wherein said latch plate includes a latch post hole which registers with said latch post when the cover portion of said frame is in its closed position, whereby the latch plate lockingly engages the latch post when the latch plate is lowered by said spring means.

8. In a horizontal impact crusher having a base, an upright crusher frame on said base, and an interior crushing chamber within said crusher frame, and wherein said crusher frame includes a stationary portion having a first interior edge structure, and a cover portion movable between a closed and open position to access said interior crushing chamber, said cover portion having a second interior edge structure that mates with the first interior edge structure of the stationary portion of said frame when said cover portion is closed, and said frame including latch means for latching the stationary portion and moveable cover portion of said crusher frame together in a closed position, the improvement comprising a latch means in the form of at least one hydraulically actuated latch plate assembly disposed to span and releasably secure the edge structures of the stationary and cover portions of said crusher frame to releasably maintain closure of said cover portion, said latch plate assembly including a latch post positioned along the edge structure of one of the stationary and cover portions of said crusher frame, a latch plate positioned along the edge structure of the other of the stationary and cover portions of said frame in opposition to said latch post, said latch plate extending over and having a latch post hole which registers with said latch post when the cover portion of said frame is in its closed position, and hydraulic means for raising and lowering said latch plate when the cover portion of said frame is in its closed position such that said latch post is disengaged and engaged by said latch plate for unlocking and locking the cover portion of the crusher frame.

9. The latch plate assembly of claim 8 wherein the hydraulic means for raising and lowering said latch plate causes said latch plate to rise by exerting a sufficient hydraulic actuation force thereon and permits the latch plate to lower in the absence of said hydraulic actuation force.

10. The latch plate assembly of claim 9 further comprising spring means for mechanically biasing said latch plate so that it is lowered onto said latch post in the absence of a sufficient hydraulic actuation force from said hydraulic means whereby the latch plate remains in a normally locked position.

11. The latch plate assembly of claim 8 wherein at least two latch plate assemblies are provided along the interior edge structures of said frame.

* * * * *